US006948806B2

(12) United States Patent
Tarnawskyj et al.

(10) Patent No.: US 6,948,806 B2
(45) Date of Patent: Sep. 27, 2005

(54) POLYIMIDE FILM SUBSTRATE PRE-HEATER ASSEMBLY AND A PHASE CHANGE INK IMAGING MACHINE INCLUDING SAME

(75) Inventors: Ihor W. Tarnawskyj, Webster, NY (US); Ralph A. Mosher, Rochester, NY (US); Laurence J. Lynd, Macedon, NY (US); David H. Pan, Rochester, NY (US); Eilleen R. Aviles, Webster, NY (US)

(73) Assignee: Xerox Corporation, Stamford, CT (US)

( * ) Notice: Subject to any disclaimer, the term of this patent is extended or adjusted under 35 U.S.C. 154(b) by 76 days.

(21) Appl. No.: 10/320,821

(22) Filed: Dec. 16, 2002

(65) Prior Publication Data

US 2004/0114015 A1 Jun. 17, 2004

(51) Int. Cl.[7] ..... B41J 2/175; B41J 2/01

(52) U.S. Cl. ..... 347/88; 347/102

(58) Field of Search ..... 400/120.08, 198; 347/102, 104, 88, 89; 101/488; 219/216; 198/844.1, 844.2

(56) References Cited

U.S. PATENT DOCUMENTS

| | | | | | |
|---|---|---|---|---|---|
| 4,636,803 | A | | 1/1987 | Mikalsen | 346/1.1 |
| 4,739,339 | A | | 4/1988 | DeYoung et al. | 346/1.1 |
| 5,038,157 | A | | 8/1991 | Howard | 346/140 R |
| 5,372,852 | A | | 12/1994 | Titterington et al. | 427/288 |
| 5,539,437 | A | * | 7/1996 | Penwell | 347/54 |
| 5,549,193 | A | * | 8/1996 | Schlueter et al. | 198/844.2 |
| 5,765,085 | A | * | 6/1998 | Law et al. | 399/329 |
| 5,896,154 | A | * | 4/1999 | Mitani et al. | 347/102 |
| 6,053,608 | A | | 4/2000 | Ishii et al. | 347/88 |
| D453,787 | S | | 2/2002 | Mattern | D18/56 |
| 6,495,801 | B2 | * | 12/2002 | Fromson et al. | 219/388 |
| 6,513,924 | B1 | * | 2/2003 | Goldberg et al. | 347/106 |

* cited by examiner

*Primary Examiner*—Thinh Nguyen
*Assistant Examiner*—Julian D. Huffman
(74) *Attorney, Agent, or Firm*—Tallam I. Nguti

(57) ABSTRACT

A polyimide film substrate pre-heater assembly is provided for pre-heating substrates in an image producing machine and includes (a) plural rollers including a drive roller; (b) a substrate path defining and heating assembly for defining a portion of substrate path; and (c) a belt assembly including a polyimide film belt forming a loop. The loop forms a substrate transport nip against the substrate path defining and heating assembly. The polyimide film belt includes a polyimide film support layer, a puzzle cut seam having inter-fitting teeth and receptacle members, and a fluoroelastomeric overcoat layer for filling and strengthening the puzzle cut seam, thereby preventing the inter-fitting teeth and receptacle members thereof from popping up when the loop is driven over relatively small diameter rollers.

10 Claims, 2 Drawing Sheets

POLYIMIDE FILM SUBSTRATE PRE-HEATER ASSEMBLY AND A PHASE CHANGE INK IMAGING MACHINE INCLUDING SAME

BACKGROUND OF THE INVENTION

This invention relates generally to substrate heating devices, and more particularly to a polyimide film substrate pre-heater assembly and a high-speed phase change ink image producing machine or printer using same.

In general, phase change ink image producing machines or printers employ phase change inks that are in the solid phase at ambient temperature, but exist in the molten or melted liquid phase (and can be ejected as drops or jets) at the elevated operating temperature of the machine or printer. At such an elevated operating temperature, droplets or jets of the molten or liquid phase change ink are ejected from a printhead device of the printer onto a printing media. Such ejection can be directly onto a final image receiving substrate, or indirectly onto an imaging member before transfer from it to the final image receiving media. In any case, when the ink droplets contact the surface of the printing media, they quickly solidify to create an image in the form of a predetermined pattern of solidified ink drops.

An example of such a phase change ink image producing machine or printer, and the process for producing images therewith onto image receiving sheets is disclosed in U.S. Pat. No. 5,372,852 issued Dec. 13, 1994 to Titterington et al. As disclosed therein, the phase change ink printing process includes raising the temperature of a solid form of the phase change ink so as to melt it and form a molten liquid phase change ink. It also includes applying droplets of the phase change ink in a liquid form onto an imaging surface in a pattern using a device such as an ink jet printhead. The process then includes solidifying the phase change ink droplets on the imaging surface, transferring them the image receiving substrate, and fixing the phase change ink to the substrate.

Conventionally, the solid form of the phase change is a "stick", "block", "bar" or "pellet" as disclosed for example in U.S. Pat. No. 4,636,803 (rectangular block 24, cylindrical block 224); U.S. Pat. No. 4,739,339 (cylindrical block 22); U.S. Pat. No. 5,038,157 (hexagonal bar 12); U.S. Pat. No. 6,053,608 (tapered lock with a stepped configuration). Further examples of such solid forms are also disclosed in design patents such as U.S. Design Pat. No. D453,787 issued Feb. 19, 2002. In use, each such block form "stick", "block", "bar" or "pellet" is fed into a heated melting device that melts or phase changes the "stick", "block", "bar" or "pellet" directly into a print head reservoir for printing as described above.

Conventionally, phase change ink image producing machines or printers, particularly color image producing such machines or printers, are considered to be low throughput, typically producing at a rate of less than 30 prints per minute (PPM). The throughput rate (PPM) of each phase change ink image producing machine or printer employing solid phase change inks in such "stick", "block", "bar" or "pellet" forms is directly dependent on how quickly such a "stick", "block", "bar" or "pellet" form can be melted down into a liquid. The quality of the images produced depends on such a melting rate, and on the types and functions of other subsystems employed to treat and control the phase change ink as solid and liquid, the imaging member and its surface, the printheads, and the image receiving substrates.

There is therefore a need for a relatively high-speed phase change ink image producing machine or printer that is also capable of producing relatively high quality images, particularly color images on plain paper substrates.

SUMMARY OF THE INVENTION

In accordance with the present invention, there is provided a polyimide film substrate pre-heater assembly is provided for pre-heating substrates in an image producing machine and includes (a) plural rollers including a drive roller; (b) a substrate path defining and heating assembly for defining a portion of substrate path; and (c) a belt assembly including a polyimide film belt forming a loop. The loop forms a substrate transport nip against the substrate path defining and heating assembly. The polyimide film belt includes a polyimide film support layer, a puzzle cut seam having inter-fitting teeth and receptacle members, and a fluoroelastomeric overcoat layer for filling and strengthening the puzzle cut seam, thereby preventing the inter-fitting teeth and receptacle members thereof from popping up when the loop is driven over relatively small diameter rollers.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
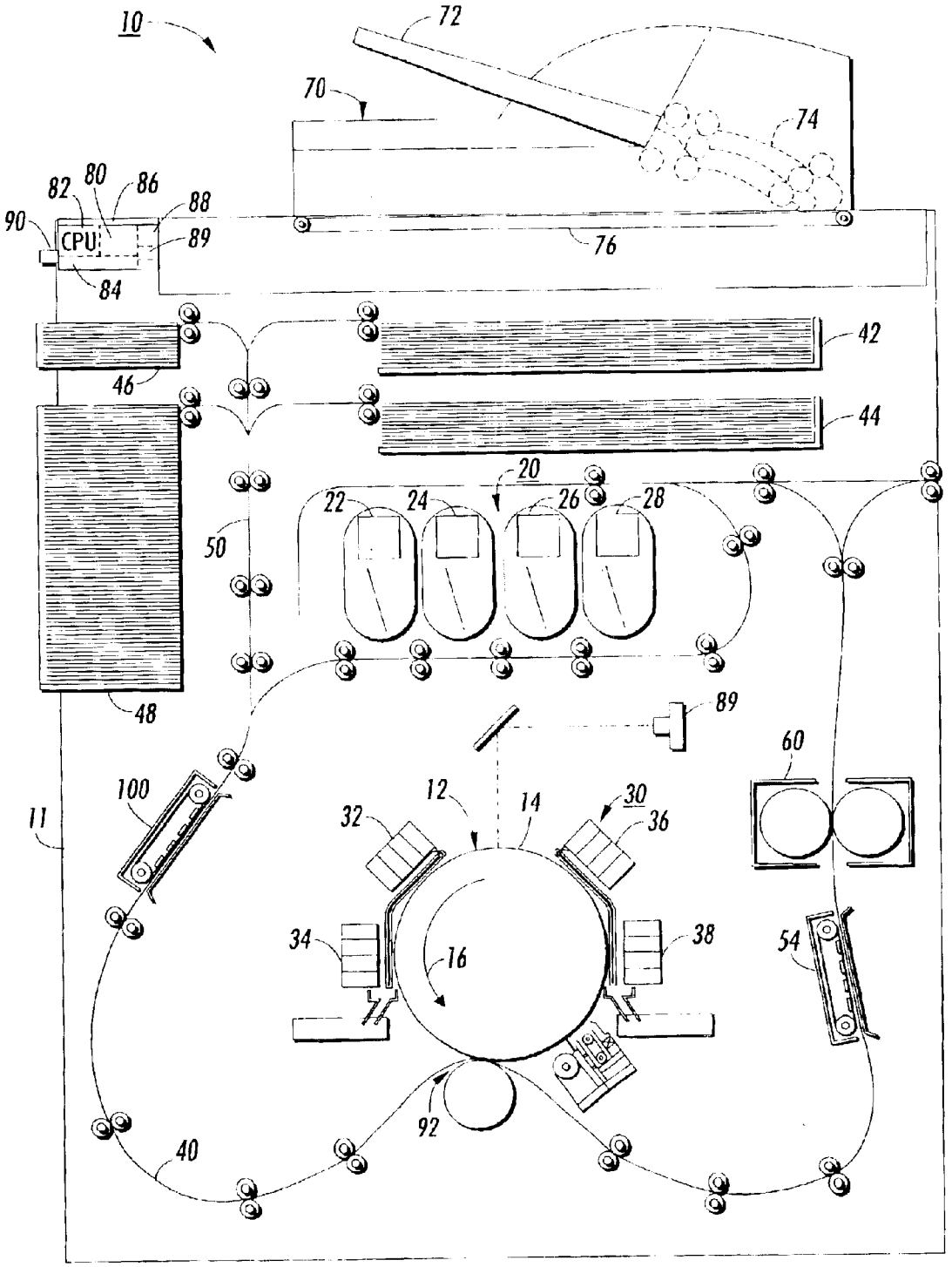
FIG. 1 is a vertical schematic of an exemplary high-speed phase change ink image producing machine or printer including the polyimide film substrate pre-heater assembly of the present invention.

Referring now to FIG. 1, there is illustrated an image producing machine, such as an exemplary high-speed phase change ink image producing machine or printer 10 of the present invention. As illustrated, the machine 10 includes a frame 11 to which are mounted directly or indirectly all the operating subsystems and components thereof as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes melting and control apparatus (not shown in FIG. 1) for melting or phase changing the solid form of the phase change ink into a liquid 20 form, and then supplying the liquid form to a printhead system 30 including at least one printhead assembly 32. Since the phase change ink image producing machine or printer 10 is a high-speed, or high throughput, multicolor image producing machine, the printhead system includes four (4) separate printhead assemblies 32, 34, 36 and 38 as shown.

As further shown, the phase change ink image producing machine or printer 10 includes a substrate supply and handling system 40. The substrate supply and handling system 40 for example may include substrate supply sources 42, 44, 46, 48, of which supply source 48 for example is a high capacity paper supply or feeder for storing and supplying image receiving substrates in the form of cut sheets for example. The substrate supply and handling system 40 in any case includes a substrate handling and treatment system 50 that has the polyimide film substrate pre-heater assembly 100 of the present invention (to be described in detail below). The substrate handling and treatment system 50 also includes a pre-fuser substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the machine's printing operations.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example from operator inputs via the user interface 86, and accordingly executes such controls. As a result, appropriate color solid form phase change ink is melted and delivered to the printhead assemblies, pixel placement control is exercised relative to the imaging surface 14 forming a desired image per such image data, a receiving substrates is supplied by anyone of the sources 42, 44, 46, 48 and handled by means 50 in timed registration with image formation on the surface 14, and the image is transferred within the transfer nip 92, from the surface 14 onto the receiving substrate for subsequent fusing at fusing device 60.

Figure 2:
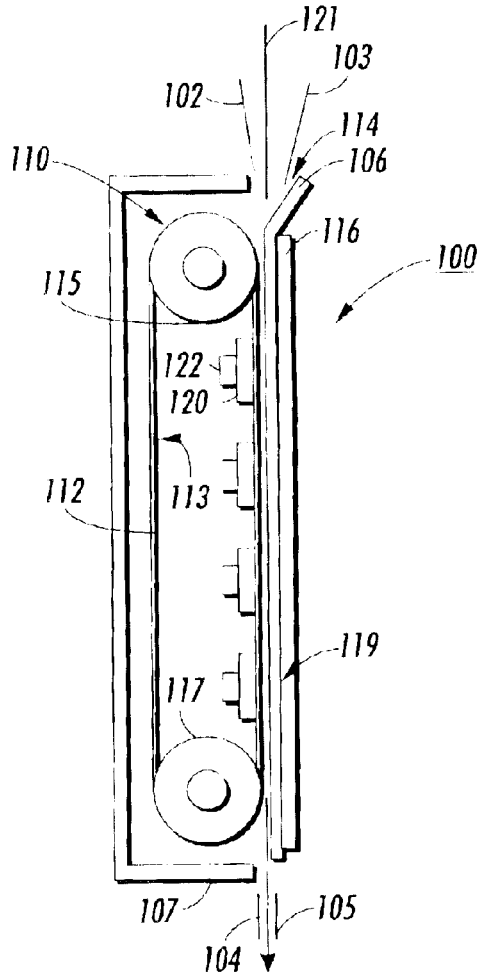
FIG. 2 is an enlarged illustration of the polyimide film substrate pre-heater assembly of the present invention.

Referring now to FIGS. 1–2, the polyimide film substrate pre-heater assembly 100 of the present invention is further illustrated in greater detail. As shown, the substrate handling and treatment system 50 includes substrate path guide baffles 102, 103 and 104, 105 located at the entrance and exit sides respectively of the polyimide film substrate pre-heater assembly 100 of the present invention. As further shown, the polyimide film substrate pre-heater assembly 100 includes plural rollers 115, 117 of which the roller 117 may be a drive roller. The polyimide film substrate pre-heater assembly 100 then a substrate path defining and heating assembly 119 for defining a portion of a substrate path 121, and a belt assembly 110 that includes a polyimide film belt 112 forming a loop 113. The loop 113 as shown forms a substrate transport nip 114 against the substrate path defining and heating assembly 119.

Figure 3:
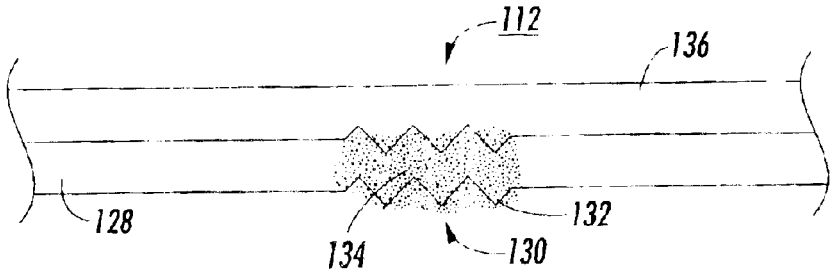
FIG. 3 is a cross-section of the film belt of the polyimide film substrate pre-heater assembly of the present invention.

Referring now to FIGS. 1–3, the polyimide film belt 112 includes a thermally conductive polyimide film support layer 128, a puzzle cut seam 130 having inter-fitting teeth and receptacle members 132 bonded by an adhesive 134, and a fluoroelastomeric overcoat layer 136 for filling and strengthening the puzzle cut seam 130, thereby preventing the inter-fitting teeth and receptacle members 132 thereof from popping up when the loop 113 thereof is driven over relatively small diameter rollers such the rollers 115, 117. Similarly seamed belts and puzzle cut technology are disclosed for example in pending U.S. application Ser. No. 09/833,964 entitled "Flashless Hot melt Bonding Of Adhesives For Imageable Seamed Belts", relevant portions of which are incorporated herein by reference.

The substrate path defining and heating assembly comprises a skid plate 106 as illustrated has a first surface, and a second and opposite. surface defining the portion of the substrate path 121, and a heating element 116 attached to the first surface for heating the skid plate and the portion of the substrate path 121. The skid plate 106 is made of a thermally conductive material, for example aluminum.

The belt assembly 110 as shown includes a series of belt support such as backer bars 120, and heating members 122 mounted inside the loop 113 for supporting and heating the polyimide film belt 112 and the portion of the substrate path 121. A housing 107 is mounted partially over the loop 113 for protecting the film belt 112 and for retaining heat from the series of belt support and heating members 120, 122 within the portion of the substrate path 121 for pre-heating a substrate being transported therethrough.

Specifically, the polyimide film belt 112 is about 75 micron thick, and the overcoat layer 136 is approximately a 40 micron thick. The overcoat layer 136 is a carbon-filled antistatic fluoroelastomer layer that is tough, resistant to wear, has a low coefficient of friction, good release properties, and good resistance to heat and chemicals which serve well for high speed, long term substrate transport. The overcoat layer 136 also serves to strengthen the seam by filling in the areas between the petals that is the teeth and receptacle members 132 of the puzzle cut seam 130, thus preventing them from popping up during flexing over rollers and other radial surfaces.

The antistatic overcoat layer 136 is comprised of fluorinated carbon, Accufluor 2028, MIBK, MgO, $Ca(OH)_2$ dispersed in Tetrapolymer of tetrafluoroethylene, hexafluoropropylene, vinylidene fluoride and a cross-link site monomer or (Viton GF Trademark of E.I. DuPont). The dispersion for the overcoat layer 136 can be made for example in the following manner. About 2300 g of steel shot blasting media, 9 g of fluorinated carbon (such as ACCUFLUOR® 2028 (fluorinated carbons from Advance Research Chemicals, Inc., Catoosa, Okla.)) and about 200 g of MIBK (Methyl Isobutyl Ketone) were added to a small bench top attritor. The mixture was gently stirred for a few minutes so that the fluorinated carbon particles became wet and mixed with the solvent Methyl Isobutyl Ketone. Viton GF at 45 g, MgO at 0.9 g and $Ca(OH)_2$ at 0.45 g were then added and the mixture was attrited for 45 minutes at moderate speed to form a dispersion. The dispersion was then filtered through a wire screen to separate out the steel shot. The final dispersion suitable for forming the layer 136 was then collected in an 8-Oz polypropylene bottle. Diak III catalyst at 10 PPH was added to the final dispersion and mixed well prior to using it for coating. The attritor was used because of a need for rapid sample preparation and because of the high quality of fine dispersions that can be produced using an attritor. The final coating dispersion was applied to the top of the film belt 112 by a flow coating process.

As can be seen, there has been provided a polyimide film substrate pre-heater assembly is provided for pre-heating substrates in an image producing machine and includes (a) plural rollers including a drive roller; (b) a substrate path defining and heating assembly for defining a portion of substrate path; and (c) a belt assembly including a polyimide film belt forming a loop. The loop forms a substrate transport nip against the substrate path defining and heating assembly. The polyimide film belt includes a polyimide film support layer, a puzzle cut seam having inter-fitting teeth and receptacle members, and a fluoroelastomeric overcoat layer for filling and strengthening the puzzle cut seam, thereby preventing the inter-fitting teeth and receptacle members thereof from popping up when the loop is driven over relatively small diameter rollers.

While the embodiment of the present invention disclosed herein is preferred, it will be appreciated from this teaching that various alternative, modifications, variations or improvements therein may be made by those skilled in the art, which are intended to be encompassed by the following claims.

What is claimed is:

1. A high-speed phase change ink image producing machine comprising:

(a) a movable imaging member having an imaging surface;

(b) a printhead system connected to said control subsystem for pixel-wise ejecting drops of melted liquid phase change ink onto said imaging surface to form an image;

(c) a substrate supply and handling system for feeding image receiving substrates to an image transfer station to receive the formed image; and (c) a polyimide film substrate pre-heater assembly located upstream of the image transfer station, said polyimide film substrate pre-heater assembly including:

(i) plural rollers including a drive roller;

(ii) a substrate path defining and heating assembly for defining a portion of substrate path; and (iii) a belt assembly including a polyimide film belt forming a loop, said loop forming a substrate transport nip against said substrate path defining and heating assembly, and said polyimide film belt including a polyimide film support layer, a puzzle cut seam having inter-fitting teeth and receptacle members, and a fluoroelastomeric overcoat layer, said overcoat layer includes fluorinated carbon, for filling and strengthening said puzzle cut seam, thereby preventing said inter-filling teeth and receptacle members thereof from popping up when said loop is driven over relatively small diameter rollers.

2. The image producing machine of claim 1, wherein said substrate path defining and heating assembly comprises a skid plate having a first surface, and a second and opposite surface defining said portion of said substrate path, and a heating element attached to said first surface for heating said skid plate and said portion of said substrate path.

3. The image producing machine of claim 2, wherein said skid plate is made of a thermally conductive material.

4. The image producing machine of claim 2, wherein said skid plate is made of aluminum.

5. The image producing machine of claim 1, wherein said belt assembly includes a series of belt support and heating members mounted inside said loop for supporting and heating said polyimide film belt and said portion.

6. The image producing machine of claim 5, wherein said series of belt support and heating members comprise a series of backer bars each having an attached heating element.

7. The image producing machine of claim 1, wherein said belt assembly includes a housing mounted partially over said loop for protecting said film belt and for retaining heat from said series of belt support and heating members within said portion of said substrate path.

8. The image producing machine of claim 1, wherein said puzzle cut seam includes an adhesive for binding said teeth and receptacle members together.

9. The image producing machine of claim 1, wherein said overcoat layer includes fluorinated carbon.

10. The image producing machine of claim 1, wherein said overcoat layer includes a fluoroelastomer.

* * * * *